US011152725B2

(12) United States Patent
Hung et al.

(10) Patent No.: US 11,152,725 B2
(45) Date of Patent: Oct. 19, 2021

(54) ELECTRICAL CONNECTOR WITH COMPLEMENTARY FEATURES ON INSULATIVE HOUSING AND SHIELDING MEMBER

(71) Applicants: ALLTOP ELECTRONICS (SHZHOU) LTD., Suzhou (CN); ALLTOP TECHNOLOGY CO., LTD., New Taipei (TW)

(72) Inventors: Yungchih Hung, New Taipei (TW); Wangi Yu, New Taipei (TW)

(73) Assignees: ALLTOP ELECTRONICS (SUZHOU) LTD., Suzhou (CN); ALLTOP TECHNOLOGY CO., LTD., New Taipei (TW)

( * ) Notice: Subject to any disclaimer, the term of this patent is extended or adjusted under 35 U.S.C. 154(b) by 503 days.

(21) Appl. No.: 16/300,544

(22) PCT Filed: Jan. 19, 2018

(86) PCT No.: PCT/CN2018/073363
§ 371 (c)(1),
(2) Date: Nov. 9, 2018

(87) PCT Pub. No.: WO2019/029131
PCT Pub. Date: Feb. 14, 2019

(65) Prior Publication Data

US 2021/0226366 A1 Jul. 22, 2021

(30) Foreign Application Priority Data

Aug. 8, 2017 (CN) ..... 201710670346.6

(51) Int. Cl.
*H01R 12/71* (2011.01)
*H01R 13/516* (2006.01)
(Continued)

(52) U.S. Cl.
CPC ..... *H01R 12/716* (2013.01); *H01R 13/516* (2013.01); *H01R 13/64* (2013.01);
(Continued)

(58) Field of Classification Search
CPC ..... H01R 12/716; H01R 13/516; H01R 13/6594; H01R 13/6582; H01R 13/64; H01R 13/73
(Continued)

(56) References Cited

U.S. PATENT DOCUMENTS 6,322,394 B1 * 11/2001 Katoh ..... H01R 13/506 439/607.11

FOREIGN PATENT DOCUMENTS

CN 201117903 Y 9/2008
CN 203466328 U 3/2014
(Continued)

*Primary Examiner* — Abdullah A Riyami
*Assistant Examiner* — Justin M Kratt
(74) *Attorney, Agent, or Firm* — Cheng-Ju Chiang

(57) ABSTRACT

An electrical connector comprises an insulative housing and a terminal module. The insulative housing has a mating portion and a main portion, the mating portion defines a mating cavity, the main portion has a receiving space. The terminal module includes a first terminal module and a second terminal module, the first terminal module defines a plurality of first contacting portions and the second terminal module defines a plurality of second contacting portions. The main portion has a pair of lateral walls, and the mating portion defines a pair of side walls. The main portion further has a plurality of ribs and a plurality of positioning slots, the ribs are attached on the exterior side faces of the relative side walls. The electrical connector further comprises a shielding member provided with a pair of side plates engaged with the positioning slots.

13 Claims, 6 Drawing Sheets

(51) Int. Cl.

| | |
|---|---|
| ***H01R 13/64*** | (2006.01) |
| ***H01R 13/6582*** | (2011.01) |
| ***H01R 13/6594*** | (2011.01) |
| ***H01R 13/73*** | (2006.01) |

(52) U.S. Cl.
CPC ..... *H01R 13/6582* (2013.01); *H01R 13/6594* (2013.01); *H01R 13/73* (2013.01)

(58) Field of Classification Search
USPC ..... 439/607.35, 607.37, 607.4
See application file for complete search history.

(56) References Cited

FOREIGN PATENT DOCUMENTS

| | | | | | |
|---|---|---|---|---|---|
| CN | 104682118 | A | | 6/2015 | |
| CN | 205335540 | U | | 6/2016 | |
| CN | 205882239 | U | | 1/2017 | |
| CN | 206532931 | U | * | 9/2017 | ..... H01R 13/436 |
| CN | 107394479 | A | | 11/2017 | |
| TW | M484832 | U | | 8/2014 | |

* cited by examiner

ELECTRICAL CONNECTOR WITH COMPLEMENTARY FEATURES ON INSULATIVE HOUSING AND SHIELDING MEMBER

CROSS REFERENCE OF THE RELATED APPLICATIONS

This application is a 35 U. S. C. § 371 National Phase conversion of International (PCT) Patent Application No. PCT/CN2018/073363, filed on Jan. 19, 2018, which claims priority of the Chinese patent application No. 201710670346.6, filed on Aug. 8, 2017 and with the title of "electrical connector", which is incorporated herein by reference in its entirety. The PCT International Patent Application was filed in Chinese.

FIELD OF THE INVENTION

The present invention relates to an electrical connector, and more particularly to an electrical connector with a better coplanarity of the soldering surfaces.

BACKGROUND OF THE INVENTION

Electrical connectors are indispensable components in electronic devices, with the upgrading of the electronic devices, electrical connectors have been developed into quite mature products. For an electrical connector, it is necessary to be able to transmit signal or current in a stable, reliable, and high-speed manner. Generally speaking, for an electrical connector with double or multi-row soldering surfaces of terminals, it is particularly important to pay attention to the coplanarity of the soldering surfaces of entire electrical connector. If the coplanarity of the soldering surfaces is inconsistent, an empty welding may be formed, which makes the electrical connector unable to achieve reliable and stable transmission, and the electrical connector after welding is difficult to test.

Hence, it is desired to provide an electrical connector to overcome the problems mentioned above.

BRIEF SUMMARY OF THE INVENTION

Accordingly, an object of the present invention is to provide an electrical connector with a better coplanarity of the soldering surfaces can be assembled conveniently.

The present invention is directed to an electrical connector comprising an insulative housing and a terminal module fixed in the insulative housing. The insulative housing has a mating portion and a main portion extending backwards from the mating portion, the mating portion defines a mating cavity recessed in a front-to-back direction, the main portion has a receiving space depressed from a rear face thereof in a back-to-front direction. The terminal module comprises a first terminal module and a second terminal module cooperated with each other, the first terminal module defines a plurality of first contacting portions received in the mating cavity and the second terminal module defines a plurality of second contacting portions, the first contacting portions and the second contacting portions are opposite to each other along an up-and-down direction. The electrical connector further has a shielding member surrounding on the mating portion of the insulative housing. The main portion has a pair of lateral walls on both sides of the receiving space, and the mating portion defines a pair of side walls on both sides of the mating cavity, the main portion further has a plurality of ribs extending forwardly from front ends of the lateral walls and a plurality of positioning slots, and every two neighboring ribs are spaced apart from each other in the up-and-down direction to form one positioning slot, the ribs are attached on the exterior side faces of the relative side walls, the shielding member is provided with a pair of side plates engaged with the positioning slots;

at least one of the side wall is provided with a groove recessed inwards from an exterior side face thereof, and at least one side plate defines an elastic pushing arm scudding against the groove, the shielding member is assembled to the mating portion along a front-and-back direction resorting to the elastic pushing arm.

As further improvement of the present invention, the first terminal module comprises a first insulator and a plurality of first terminals insert-molded in the first insulator, each first terminal defines a first retaining portion held in the first insulator and a first contacting portion extending forwards from the first retaining portion, the second terminal module comprises a second insulator and a plurality of second terminals insert-molded in the second insulator, each second terminal is provided with a second retaining portion molded in the second insulator and a second contacting portion extending forwards from the second retaining portion, the first insulator and the second insulator are cooperated with each other, and received in the receiving space together.

As further improvement of the present invention, at least one lateral wall defines a first guiding slot extending along a front-and-back direction and a second guiding slot below the first guiding slot on an inner side thereof towards the receiving space, the first guiding slot and the second guiding slot are communicated with the receiving space.

As further improvement of the present invention, the first insulator has a first leading portion matching with the first guiding slot, and the second insulator has a second leading portion engaging with the second guiding slot, the first terminal module further defines a third insulator cooperated with the first insulator to retain the first terminals, and the third insulator defines a third leading portion aligning with the second leading portion along the front-and-back direction.

As further improvement of the present invention, at least one lateral wall of the main portion defines a first retaining groove recessed outwards from the first guiding slot, and the first retaining groove is penetrating through the lateral wall, the first insulator defines a first tab protruding outwards from the first leading portion, the first tab is cooperated with the first retaining groove to make the first insulator be fastened in the receiving space.

As further improvement of the present invention, the main portion further has a second retaining groove recessed outwards from the second guiding slot and a third retaining groove, and the second retaining groove is penetrating through the lateral wall, the third retaining groove is located behind the second retaining groove, the first retaining groove and the second retaining groove are aligned with each other in a thickness direction of the electrical connector.

As further improvement of the present invention, the second insulator defines a second tab protruding outwards from the second leading portion, the second tab is cooperated with the second retaining groove to make the second insulator be fastened in the receiving space, the third insulator comprises a third tab protruding outwards from the third leading portion, the third tab is cooperated with the third retaining groove to make the third insulator be fastened in the receiving space.

As further improvement of the present invention, the second insulator has a second flange extruding upwards from a top surface of the second leading portion, and the second flange extends along a back-to-front direction, the third insulator defines a third flange extruding upwards from a top surface of the third leading portion, the second flange is aligned with the third flange along the front-and-back direction, the second flange and the third flange are abutting against top surface of the second guiding slot.

As further improvement of the present invention, the first insulator defines a first lower surface and a plurality of first extruding portions protruding downwards from the first lower surface, the second insulator defines a second upper surface abutting against the first lower surface, a second lower surface opposite to the second upper surface and a plurality of matching cavities recessed from the second upper surface, the matching cavities extend backwards to through the second insulator, the first extruding portions are cooperated in the corresponding matching cavities.

As further improvement of the present invention, the shielding member is provided with a top plate and the pair of side plates bending downwards from both sides of the top plate.

As further improvement of the present invention, each side plate defines a pair of locking arms extending rearwards and the elastic pushing arm on a lower side thereof, the locking arms are latched in the corresponding positioning slots.

As further improvement of the present invention, the elastic pushing arm is formed by tearing from the relative side plate, and provided with a connecting portion connected with the side plate and an elastic portion indented inwards from the connecting portion along the width direction of the electrical connector.

As further improvement of the present invention, the shielding member further defines a pushing wall extending backwards from the top plate, and the pushing wall is shielding above a top wall of the mating portion.

The insulative housing of the electrical connector according to the present invention defines is formed with the ribs at the side walls of the insulative housing and the positioning slots between two relative neighboring ribs, the shielding member can be fastened to the insulative housing, thus the shielding member of the electrical connector and the insulative housing are stationary fitted with each other along a mating direction, at the same time, the shielding member will not affect the electrical connector along the up-and-down direction, therefore the soldering portions of the electrical connector can have a better coplanarity for a convenient subsequent installation.

Other objects, advantages and novel features of the invention will become more apparent from the following detailed description of the present embodiment when taken in conjunction with the accompanying drawings.

DETAILED DESCRIPTION OF THE EMBODIMENTS

Figure 1:
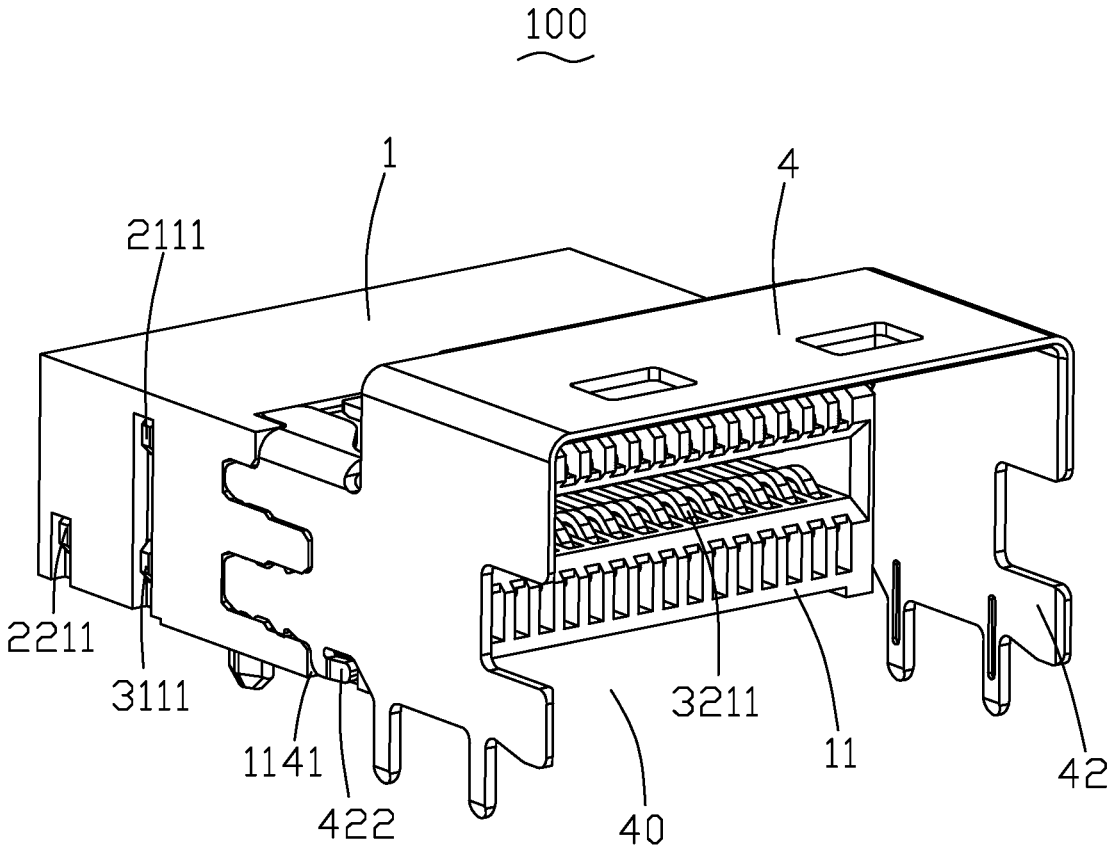
FIG. 1 is an assembled perspective view of an electrical connector in accordance with the present invention.
Figure 2:
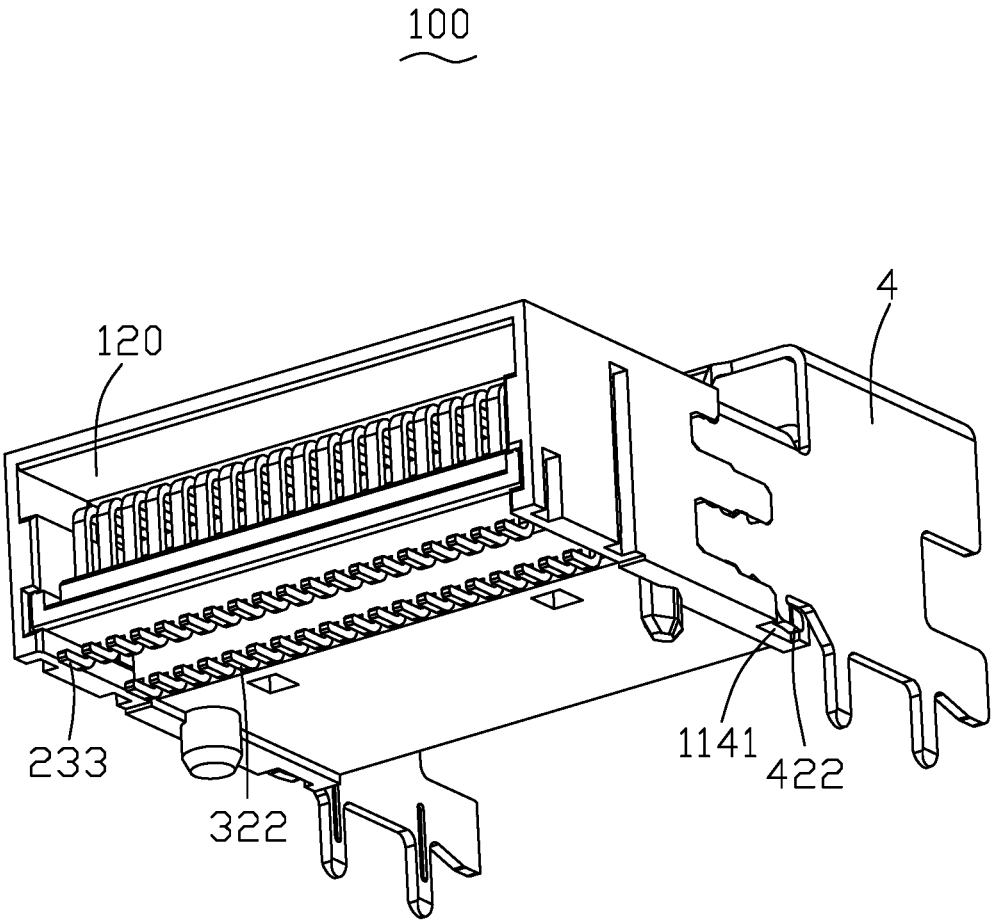
FIG. 2 is similar to FIG. 1, but shown from a different aspect.

In order to make the objects, technical solutions, and advantages according to the present invention clearer, the present invention will be described in detail below with reference to the specific embodiments and drawings.

Please refer to FIG. 1 to FIG. 6, showing an electrical connector 100 in present invention, the electrical connector 100 comprises an insulative housing 1, a terminal module (not labeled) fixed in the insulative housing 1 and a shielding member 4 enclosing the insulative housing 1.

The insulative housing 1 has a mating portion 11 and a main portion 12 integrally extending backwards from the mating portion 11. The mating portion 11 defines a mating face 111 in the most front thereof, a mating cavity 110 recessed backwardly from the mating face 111, a bottom wall 112 located below the mating cavity 110, a top wall 113 above the mating cavity 110, and a pair of side walls 114 connecting the bottom wall 112 and the top wall 113. The top wall 113 is provided with a plurality of passageways 115 recessed in a down-to-up direction, and the bottom wall 112 is provided with a plurality of passageways 115 recessed in an up-to-down direction, and there is a one-to-one correspondence between the passageways 115 in the bottom wall 112 and the passageways 115 in the top wall 113, and each passageway 115 in the bottom wall 112 is opposite to the corresponding passageway 115 in the top wall 113 in an up-and-down direction. The pair of side walls 114 are located on opposite sides of the mating cavity 110, and each side wall 114 defines a guiding surface 1101 at a frond end thereof, the guiding surface 1101 extends backwards from the mating face 111 slantways, thus for a complementary connector (not shown) plugging into conveniently. Each side wall 114 is provided with a groove 1141 close to the mating face 111, and each groove 1141 is recessed inwards from an exterior side face of the relative side wall 114, in particular, each groove 1141 is extending through the bottom wall 112 along the up-and-down direction.

The main portion 12 has a receiving space 120 depressed from a rear face thereof in a back-to-front direction, a pair of lateral walls 121 on both sides of the receiving space 120, an upper wall 122 above the receiving space 120 and a lower wall 123 below the receiving space 120. In addition, the main portion 12 defines a plurality of ribs 1211 extending forwardly from front ends of the lateral walls 121 and a plurality of positioning slots 1212, and every two neighboring ribs 1211 are spaced apart from each other in the up-and-down direction to form one positioning slot 1212, the ribs 1211 are attached on the exterior side faces of the relative side walls 114. The lower wall 123 and the bottom wall 112 are integrally formed, and a bottom face of the lower wall 123 is coplanar with a bottom face of the bottom wall 112.

Figure 3:
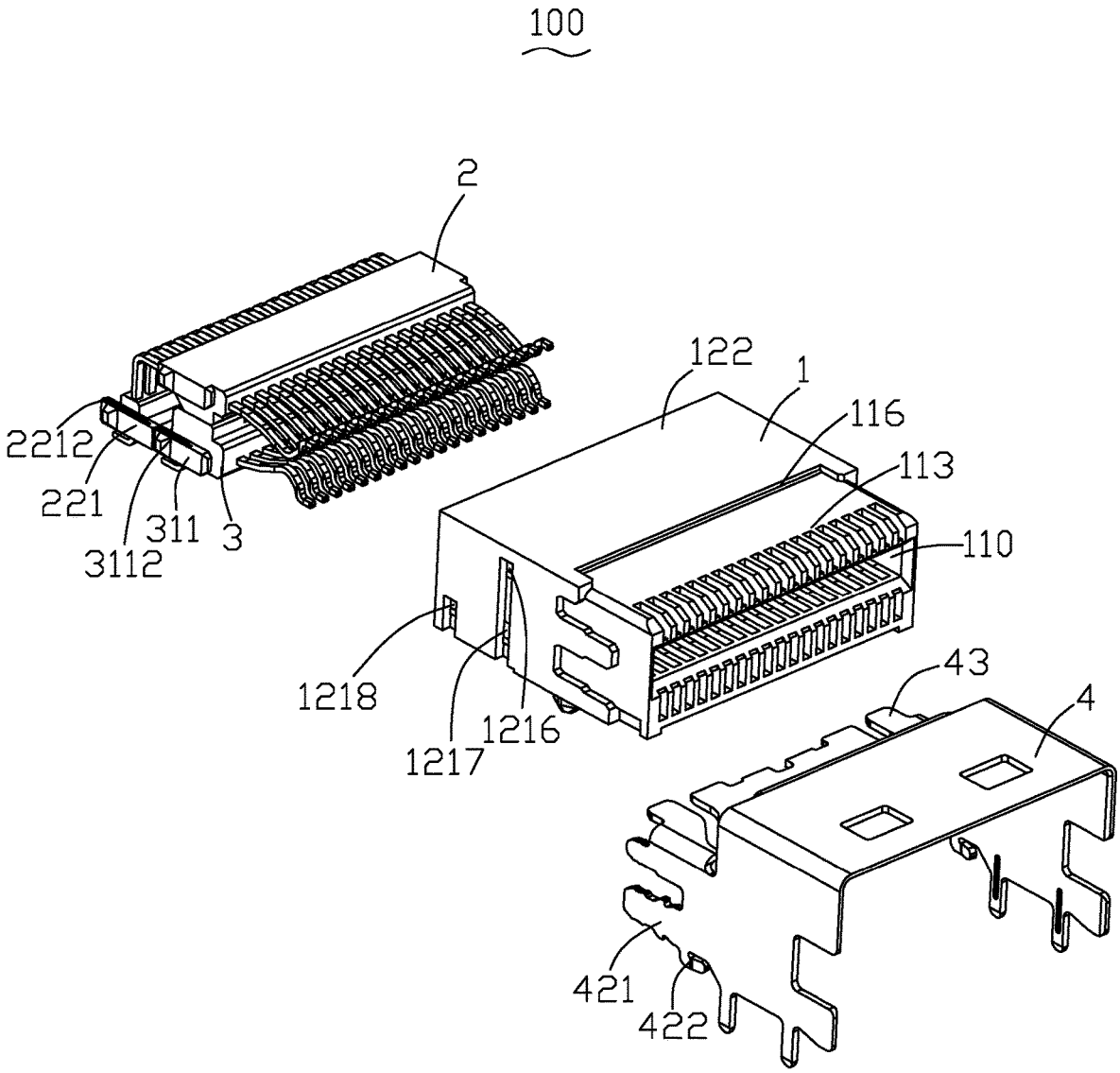
FIG. 3 is a partial exploded view of the electrical connector in accordance with the present invention.
Figure 4:
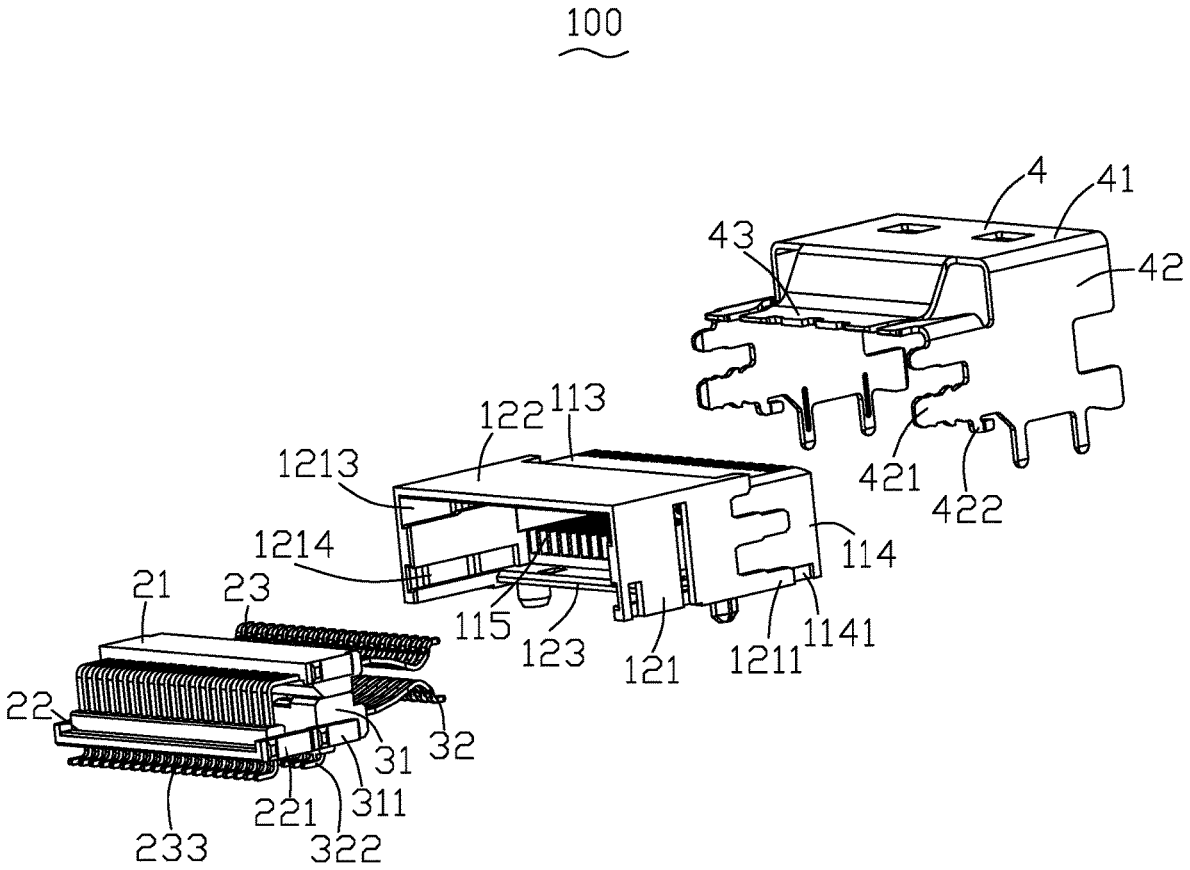
FIG. 4 is another partial exploded view of the electrical connector shown from a different aspect.
Figure 5:
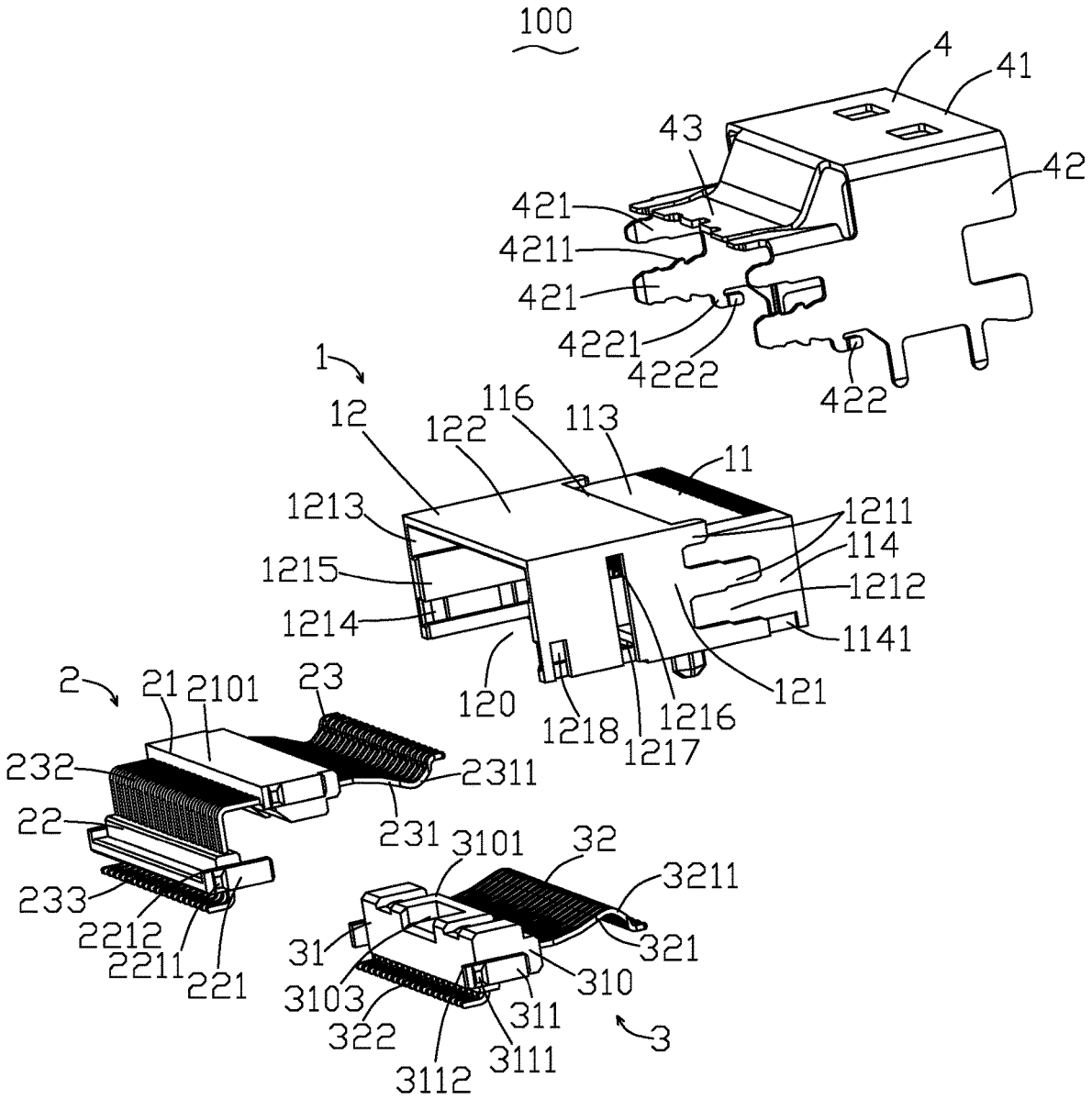
FIG. 5 is an exploded view of the electrical connector in accordance with the present invention.
Figure 6:
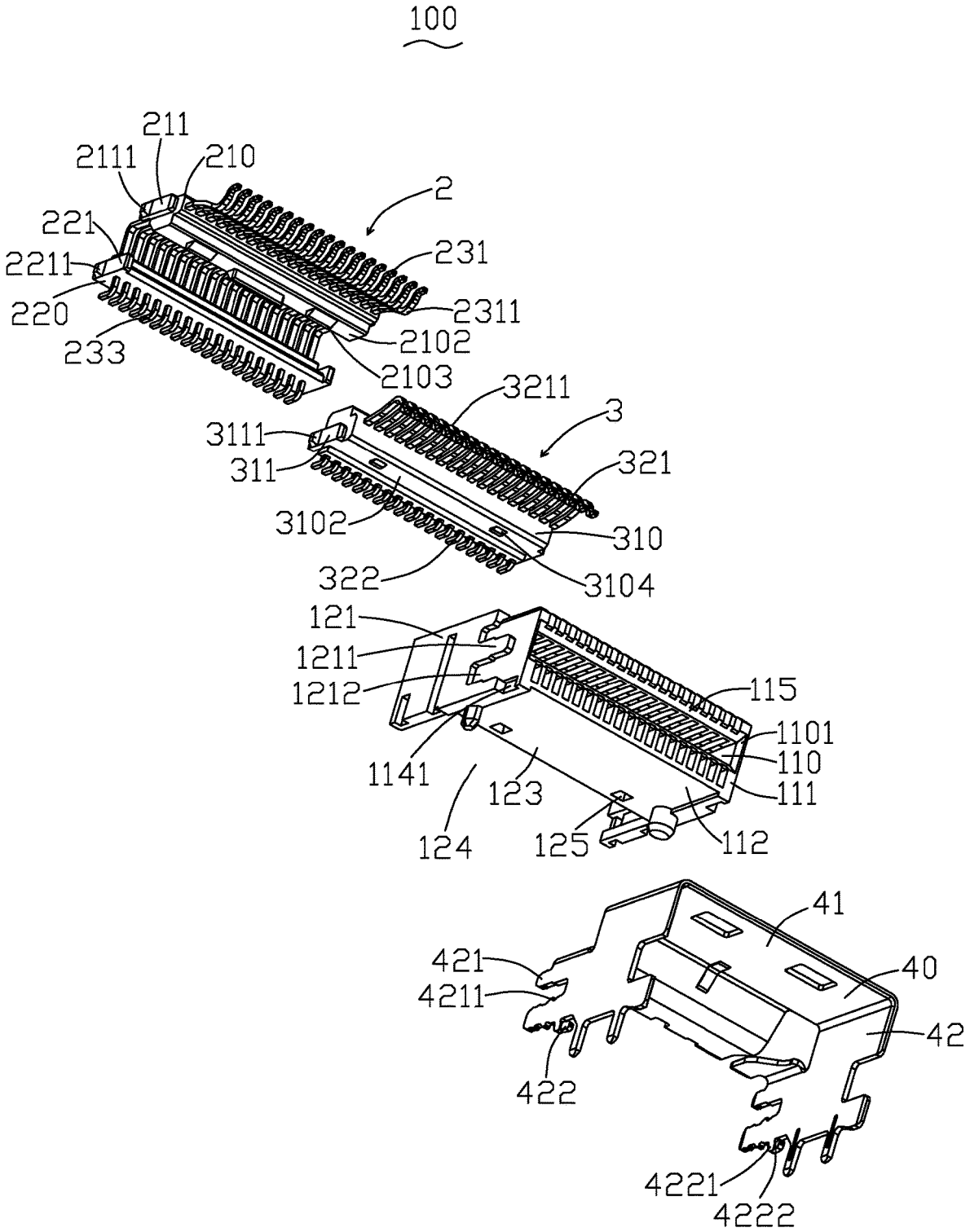
FIG. 6 is another exploded view of the electrical connector in accordance with the present invention.

In conjunction with FIG. 3, a top surface of the upper wall 122 is higher than a top surface of the top wall 113 along the up-and-down direction, and a stepped stopping portion 116 is form at a conjunction area between the upper wall 122 and the top wall 113. A yielding space 124 is running through a back section of the lower wall 123, and communicated with the receiving space 120. A pair of through holes 125 are defined through the lower wall 123, and arranged abreast along the width direction of the electrical connector 100.

Each lateral wall 121 is provided with a first guiding slot 1213 extending along a front-and-back direction and a second guiding slot 1214 below the first guiding slot 1213 on an inner side thereof towards the receiving space 120, and the first guiding slot 1213 is separated from the second guiding slot 1214 in the up-and-down direction by a partition 1215 therebetween. The first guiding slot 1213 and the second guiding slot 1214 are communicated with the receiving space 120 along the width direction of the electrical connector 100, and the first guiding slot 1213 and the second guiding slot 1214 are penetrating through the relative lateral wall 121 from front to rear.

Each lateral wall 121 defines a first retaining groove 1216 recessed outwards from the first guiding slot 1213, a second retaining groove 1217 recessed outwards from the second guiding slot 1214 and a third retaining groove 1218. The first retaining groove 1216 and the second retaining groove 1217 are penetrating through the corresponding lateral wall 121, the third retaining groove 1218 is located behind and aligning with the second retaining groove 1217 along the front-and-back direction. The first retaining groove 1216 and the second retaining groove 1217 are aligned with each other in a thickness direction of the electrical connector 100.

The terminal module includes a first terminal module 2 and a second terminal module 3 cooperated with each other. The first terminal module 2 comprises a first insulator 21, a third insulator 22 and a plurality of first terminals 23 insert-molded in the first insulator 21 and the third insulator 22, the first insulator 21 and the third insulator 22 are completely independent of each other. Each first terminal 23 defines a first retaining portion (not labeled) held in the first insulator 21, a first contacting portion 231 extending forwards from the first retaining portion, a first bending portion 232, a third retaining portion (not labeled) molded in the third insulator 22 and a first soldering portion 233 extending downwards from the third retaining portion. The first contacting portion 231 is received in the corresponding passageway 115 of the mating portion 11, the first bending portion 232 is extending backwards from the first retaining portion firstly, and then bending downwards. The third retaining portion extending downwards from a lower end of the first bending portion 232, the first soldering portion 233 extends downwardly beyond a lower surface of the first insulator 21, and then extends rearwards. The first contacting portion 231 is further provided with a first contacting surface 2311 protruding downwards and exposed in the mating cavity 110.

The first insulator 21 has a first base portion 210 accommodated in the receiving space 120, a pair of first leading portions 211 protruding outwards from both sides of the first base portion 210, a first upper surface 2101 on the top of the first base portion 210, a first lower surface 2102 located below the first base portion 210 and three first extruding portions 2103 protruding downwards from the first lower surface 2102. The pair of the first leading portions 211 are received in the corresponding first guiding slots 1213, the first upper surface 2101 is facing to a bottom surface of the upper wall 122. Each first leading portion 211 defines a first tab 2111 protruding outwards from an exterior surface thereof in the width direction of the electrical connector 100, and the first tab 2111 is located on a rear end of the first leading portion 211. Each first tab 2111 is cooperated with the relative first retaining groove 1216 to make the first insulator 21 be fastened in the receiving space 120.

The third insulator 22 has a third base portion 220 accommodated in the receiving space 120 and a pair of third leading portions 221 protruding outwards from both sides of the third base portion 220, and the third leading portions 221 are received in the corresponding second guiding slots 1214. Each third leading portion 221 is provided with a third tab 2211 protruding outwards from an exterior surface thereof in the width direction of the electrical connector 100 and a third flange 2212 extruding upwards. Each third tab 2211 is located on a rear end of the third leading portion 221. Each third tab 2211 is cooperated with the relative third retaining groove 1218 to make the third insulator 22 be fastened in the receiving space 120.

The second terminal module 3 comprises a second insulator 31 and a plurality of second terminals 32 insert-molded in the second insulator 31. Each second terminal 32 is provided with a second retaining portion (not labeled) molded in the second insulator 31, a second contacting portion 321 extending forwards from the second retaining portion and a second soldering portion 322 extending downwards from the second retaining portion. The second contacting portion 321 is received in the corresponding passageway 115 of bottom wall 112, the second soldering portion 322 extends downwardly beyond a lower surface of the second insulator 31, and then extends rearwards. The second contacting portion 321 is further provided with a second contacting surface 3211 protruding upwards and exposed in the mating cavity 110.

The second insulator 31 defines a second base portion 310 accommodated in the receiving space 120, a pair of second leading portions 311 protruding outwards from both sides of the second base portion 310, a second upper surface 3101 on the top of the second base portion 310, a second lower surface 3102 located below the second base portion 310 and a plurality of matching cavities 3103 recessed from the second upper surface 3101. The second leading portions 311 are received in the corresponding second guiding slots 1214, the second upper surface 3101 is abutting against the first lower surface 2102. The matching cavities 3103 extend backwards to through the second insulator 31, the first extruding portions 2103 are cooperated in the corresponding matching cavities 3103.

Each second leading portion 311 defines a second tab 3111 protruding outwards from an exterior surface thereof in the width direction of the electrical connector 100 and a second flange 3112 extruding upwards, and the second flange 3112 extends along the back-to-front direction. Each second tab 3111 is located on a rear end of the relative second leading portion 311, and each second tab 3111 is cooperated with the relative second retaining groove 1217 to make the second insulator 31 be fastened in the receiving space 120. The second insulator 31 further has a pair of extrusions 3104 projecting downwards from the second lower surface 3102, and the extrusions 3104 are associated with the corresponding through holes 125 in the lower wall 123 of the main portion 12.

When the first terminal module 2 and the second terminal module 3 assembled to the insulative housing 1, the second terminal module 3 is firstly assembled into the receiving space 120 along the back-to-front direction, and the second leading portions 311 slide forwardly in the relative second guiding slot 1214 until the second contacting portions 321 of the second terminals 32 received in the passageways 115 of the bottom wall 112. The second tabs 3111 are latched in the relative second retaining grooves 1217, and the extrusions 3104 are locked in the corresponding through holes 125, thereby the second terminal module 3 fixing into the insulative housing 1.

Then the first terminal module 2 is assembled to the receiving space 120 in the back-to-front direction, and the first leading portions 211 slide forwardly in the relative first guiding slot 1213 with the third leading portions 221 sliding forwardly in the relative second guiding slot 1214 until the first contacting portions 231 of the first terminals 23 received in the passageways 115 of the top wall 113. The first tabs 2111 are latched in the corresponding first retaining grooves 1216, the third tabs 2211 are locked in the relative third retaining grooves 1218, and the first extruding portions 2103 are accommodated in the relative matching cavities 3103, therefore the first insulator 21 is cooperated with the second insulator 31 along the up-and-down direction, and received in the receiving space 120 together with the second insulator 31. The first contacting portions 231 and the second contacting portions 321 are opposite to each other along the up-and-down direction, and received in the corresponding passageways 115. The first contacting surfaces 2311 and the second contacting surfaces 3211 are opposite to each other along the up-and-down direction, and exposed in the mating cavity 110.

The second leading portions 311 are aligning with the corresponding third leading portions 221 along the front-and-back direction, thus the first terminal module 2 and the second terminal module 3 are assembled neatly. The second flanges 3112 and the third flanges 2212 are abutting against top surfaces of the second guiding slot 1214, that is, abutting against the partition 1215. By this setting, the assembly clearance between the second insulator 31 and the third insulator 22 with the insulative housing 1 can be decreased.

The shielding member 4 is surrounding on the mating portion 11 of the insulative housing 1, and the shielding member 4 is provided with a top plate 41, a pair of side plates 42 bending downwards from both sides of the top plate 41, a containing space 40 formed by the top plate 41 and the pair of side plates 42, and a pushing wall 43 extending backwards from the top plate 41, the pushing wall 43 is shielding above the top wall 113 of the mating portion 11.

Each side plate 42 defines a pair of locking arms 421 extending rearwards, a plurality of barbs 4211 at least on one lateral edge of each locking arm 421 and an elastic pushing arm 422 on a lower side thereof, the locking arms 421 are latched in the corresponding positioning slots 1212, the elastic pushing arms 422 are scudding against the grooves 1141. In further, each elastic pushing arm 422 is formed by tearing from the relative side plate 42, and provided with a connecting portion 4221 connected with the side plate 42 and an elastic portion 4222 indented inwards from the connecting portion 4221 along the width direction of the electrical connector 100.

The barbs 4211 of the locking arms 421 are interferential with inner walls of the positioning slots 1212 to form a positioning relationship therebetween, and the elastic portions 4222 of the elastic pushing arms 422 are abutting against inner walls of the grooves 1141, therefore the shielding member 4 is assembled to the insulative housing 1 along the front-and-back direction. Thus, the shielding member 4 does not need to resort to an extra force in the up-and-down direction, and fastens with the insulative housing 1 only by an assembly in the front-and-back direction.

Additionally, the shielding member 4 does not need to define a fastening arm locked with the insulative housing 1 at the bottom, and when the electrical connector 100 soldered on a printed circuit board (not shown), it's only need to adjust the first soldering portions 233 of the first terminals 23 coplanar with the second soldering portions 322 of the second terminals 32, thus the electrical connector 100 can have a better coplanarity, thereby the electrical connector 100 welding stably without missing solder. A free end of the pushing wall 43 is abutting against the stopping portion 116 at a conjunction area between the upper wall 122 and the top wall 113.

Thus, in the electrical connector 100 according to the present invention, by forming the ribs 1211 at the side walls 114 of the insulative housing 1 and the positioning slots 1212 between two relative neighboring ribs 1211, the shielding member 4 can be fastened to the insulative housing 1, thus the shielding member 4 of the electrical connector 100 and the insulative housing 1 are stationary fitted with each other along a mating direction, at the same time, the shielding member 4 will not affect the electrical connector 100 along the up-and-down direction, therefore the soldering portions of the electrical connector 100 can have a better coplanarity for a convenient subsequent installation.

Furthermore, relative terms, such as "upper" or "top", "lower" or "bottom", "left", "right", "front" and "back", may be used herein to describe one element's relationship to another element as illustrated in the figures. It will be understood that relative terms are intended to encompass different orientations of the device in addition to the orientation depicted in the Figures, and thus shall not be understood as a limitation to the present invention. In addition, term "horizontal" is merely used for description and shall not be understood as equal to along the direction perpendicular to gravity, but allowing for a certain angle of slant.

The above embodiments are only intended for illustrating rather than limiting the technical solutions according to the present invention. Although the present invention is described in detail with reference to the preferred embodiments, it should be understood by those ordinary skilled in the art that the technical solutions according to the present invention can be modified or equivalently substituted without departing from the spirit and scope of the technical solutions.

What is claimed is:

1. An electrical connector, comprising:

an insulative housing having a mating portion and a main portion extending backwards from the mating portion, the mating portion defining a mating cavity recessed in a front-to-back direction, the main portion having a receiving space depressed from a rear face thereof in a back-to-front direction;

a terminal module fixed in the insulative housing, and comprising a first terminal module and a second terminal module cooperated with each other, the first terminal module defining a plurality of first contacting portions received in the mating cavity and the second terminal module defining a plurality of second contacting portions, the first contacting portions and the second contacting portions being opposite to each other along an up-and-down direction; and a shielding member surrounding the mating portion of the insulative housing;

wherein the main portion has a pair of lateral walls on both sides of the receiving space, and the mating portion defines a pair of side walls on both sides of the mating cavity, the main portion further has a plurality of ribs extending forwardly from front ends of the lateral walls and a plurality of positioning slots, and every two neighboring ribs are spaced apart from each other in the up-and-down direction to form one positioning slot, the ribs are attached on the exterior side faces of the relative side walls, the shielding member is provided with a pair of side plates engaged with the positioning slots; at least one of the side walls is provided with a groove recessed inwards from an exterior side face thereof, and at least one side plate defines an elastic pushing arm scudding against the groove, the shielding member is assembled to the mating portion along a front-and-back direction to until the elastic pushing arm is caught by the groove.

2. The electrical connector as claimed in claim 1, wherein the first terminal module comprises a first insulator and a plurality of first terminals insert-molded in the first insulator, each first terminal defines a first retaining portion held in the first insulator and a first contacting portion extending forwards from the first retaining portion, the second terminal module comprises a second insulator and a plurality of second terminals insert-molded in the second insulator, each second terminal is provided with a second retaining portion molded in the second insulator and a second contacting portion extending forwards from the second retaining portion, the first insulator and the second insulator are cooperated with each other, and received in the receiving space together.

3. The electrical connector as claimed in claim 1, wherein at least one lateral wall defines a first guiding slot extending along a front-and-back direction and a second guiding slot below the first guiding slot on an inner side thereof towards the receiving space, the first guiding slot and the second guiding slot are communicated with the receiving space.

4. The electrical connector as claimed in claim 3, wherein the first insulator has a first leading portion matching with the first guiding slot, and the second insulator has a second leading portion engaging with the second guiding slot, the first terminal module further defines a third insulator cooperated with the first insulator to retain the first terminals, and the third insulator defines a third leading portion aligning with the second leading portion along the front-and-back direction.

5. The electrical connector as claimed in claim 4, wherein at least one lateral wall of the main portion defines a first retaining groove recessed outwards from the first guiding slot, and the first retaining groove is penetrating through the lateral wall, the first insulator defines a first tab protruding outwards from the first leading portion, the first tab is cooperated with the first retaining groove to make the first insulator be fastened in the receiving space.

6. The electrical connector as claimed in claim 5, wherein the main portion further has a second retaining groove recessed outwards from the second guiding slot and a third retaining groove, and the second retaining groove is penetrating through the lateral wall, the third retaining groove is located behind the second retaining groove, the first retaining groove and the second retaining groove are aligned with each other in a thickness direction of the electrical connector.

7. The electrical connector as claimed in claim 6, wherein the second insulator defines a second tab protruding outwards from the second leading portion, the second tab is cooperated with the second retaining groove to make the second insulator be fastened in the receiving space, the third insulator comprises a third tab protruding outwards from the third leading portion, the third tab is cooperated with the third retaining groove to make the third insulator be fastened in the receiving space.

8. The electrical connector as claimed in claim 7, wherein the second insulator comprises a second flange extruding upwards from a top surface of the second leading portion, and the second flange extends along a back-to-front direction, the third insulator defines a third flange extruding upwards from a top surface of the third leading portion, the second flange is aligned with the third flange along the front-and-back direction, the second flange and the third flange are abutting against top surface of the second guiding slot.

9. The electrical connector as claimed in claim 2, wherein the first insulator defines a first lower surface and a plurality of first extruding portions protruding downwards from the first lower surface, the second insulator defines a second upper surface abutting against the first lower surface, a second lower surface opposite to the second upper surface and a plurality of matching cavities recessed from the second upper surface, the matching cavities extend backwards to through the second insulator, the first extruding portions are cooperated in the corresponding matching cavities.

10. The electrical connector as claimed in claim 1, wherein the shielding member is provided with a top plate and the pair of side plates bending downwards from both sides of the top plate.

11. The electrical connector as claimed in claim 10, wherein each side plate defines a pair of locking arms extending rearwards and the elastic pushing arm on a lower side thereof, the locking arms are latched in the corresponding positioning slots.

12. The electrical connector as claimed in claim 11, wherein the elastic pushing arm is formed by tearing from the relative side plate, and provided with a connecting portion connected with the side plate and an elastic portion indented inwards from the connecting portion along the width direction of the electrical connector.

13. The electrical connector as claimed in claim 10, wherein the shielding member further defines a pushing wall extending backwards from the top plate, and the pushing wall is shielding above a top wall of the mating portion.

* * * * *